US011059064B2

(12) United States Patent
Smalley et al.

(10) Patent No.: US 11,059,064 B2
(45) Date of Patent: Jul. 13, 2021

(54) DISPENSING PUMP SYSTEM WITH REMOVABLE CHAPLET

(71) Applicant: Silgan Dispensing Systems Corporation, Grandview, MO (US)

(72) Inventors: Leah E. Smalley, Grandview, MO (US); Alejandro Espinoza, Grandview, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 0 days.

(21) Appl. No.: 16/982,543

(22) PCT Filed: Mar. 19, 2019

(86) PCT No.: PCT/US2019/022944
§ 371 (c)(1),
(2) Date: Sep. 19, 2020

(87) PCT Pub. No.: WO2019/183074
PCT Pub. Date: Sep. 26, 2019

(65) Prior Publication Data

US 2021/0001362 A1 Jan. 7, 2021

Related U.S. Application Data

(60) Provisional application No. 62/646,850, filed on Mar. 22, 2018.

(51) Int. Cl.

| | |
|---|---|
| ***B05B 11/00*** | (2006.01) |
| *B05B 15/30* | (2018.01) |
| *A47K 5/12* | (2006.01) |

(52) U.S. Cl.
CPC ..... *B05B 11/3047* (2013.01); *B05B 11/3001* (2013.01); *A47K 5/1205* (2013.01); *B05B 11/3073* (2013.01); *B05B 15/30* (2018.02)

(58) Field of Classification Search
CPC . B05B 11/3047; B05B 11/3001; B05B 15/30; B05B 11/3073; B05B 11/306; A47K 5/1205
See application file for complete search history.

(56) References Cited

U.S. PATENT DOCUMENTS 5,503,302 A * 4/1996 DeJonge ..... B05B 11/0038 222/82
6,142,342 A 11/2000 Lewis
(Continued)

FOREIGN PATENT DOCUMENTS

WO 2004073876 A1 9/2004

*Primary Examiner* — Donnell A Long
(74) *Attorney, Agent, or Firm* — Barlow, Josephs & Holmes, Ltd.

(57) ABSTRACT

A dispensing pump (10) includes a removable chaplet (28) to facilitate removal of the internal metal spring components (44) for recycling. The dispensing pump (10) includes an accumulator (12) having an upper rim wall (24). The chaplet (28) is coaxially snap received about the rim wall (24) of the accumulator (12). The chaplet (28) has a body portion (30) received within the rim wall (24), and an outer wall (32) received outside of the rim wall (24). The outer wall (32) has a frangible wall portion (48) and a pull tab (50) at a terminal edge thereof. A dispensing head (36) with a piston stem (38) and spring (44) are coaxially guided within the chaplet (28) and accumulator (12). When the container is empty, the user pulls on the pull tab (50) to sever the frangible elements, releasing the chaplet (28) and allowing easy removal of the dispensing head (36) and the metallic spring component (44).

11 Claims, 6 Drawing Sheets

(56) References Cited

U.S. PATENT DOCUMENTS

| | | | | |
|---|---|---|---|---|
| 2006/0043117 | A1* | 3/2006 | Law | B05B 11/3097 222/257 |
| 2007/0181526 | A1 | 8/2007 | Frishman | |
| 2009/0120966 | A1* | 5/2009 | Limbert | B05B 11/3087 222/190 |
| 2010/0006604 | A1 | 1/2010 | Ding | |
| 2015/0102064 | A1* | 4/2015 | Taberlet | B05B 11/3054 222/153.05 |
| 2015/0190625 | A1 | 7/2015 | Andresen et al. | |
| 2017/0197227 | A1 | 7/2017 | Espinoza | |
| 2020/0023391 | A1* | 1/2020 | Cesare | B65D 47/0809 |

* cited by examiner

DISPENSING PUMP SYSTEM WITH REMOVABLE CHAPLET

BACKGROUND OF THE INVENTION

(1) Field of the Invention

The present invention generally relates to dispensing pumps for liquids, viscous flowable materials, foams, gels, etc. and more particularly to a dispensing pump with a removable chaplet.

(2) Description of Related Art

Dispensing pumps for various liquids, lotions, foams, gels, etc. are known in the art. They generally comprise an accumulator which is seated on the neck of a container, a co-acting nozzle portion which slides relative to the accumulator, and a spring which biases the co-acting nozzle portion to its normal rest position. To dispense the material in the container, the user manually depresses the nozzle which forces the material from the inside of the accumulator outwardly through the nozzle. When the nozzle is released, the spring forces the nozzle portion back to its normal resting position. Most of the pump system components are typically formed from polymer materials, with the exception of the spring, which is typically formed from metal. The plastic pump components are easily recyclable. However, the presence of the metal spring in the pump assembly has been found to impede or slow the recycling process due to the need to separate the metal spring from the other plastic components.

SUMMARY OF THE INVENTION

Exemplary embodiments of a dispensing pump for liquids, viscous materials, foams, gels, etc. include a removable chaplet which allows the pump parts to be more easily recycled.

Exemplary embodiments of the dispensing pump system include an accumulator having a dip tube port within a bottom wall and a ball valve within the dip tube port. The open upper end of the accumulator has an outward flange and an upstanding rim wall. The pump system further includes an annular closure ring securing the accumulator flange to a neck of a container.

A removable, annular chaplet is coaxially snap received about the rim wall of the accumulator. The chaplet has a body portion which is received within inner side of the rim wall, and an outer wall received on an outer side of the rim wall. The rim wall and the chaplet include mating snap formations which cooperate to maintain the chaplet in assembled relation with the rim wall.

A dispensing head includes a piston stem which is coaxially guided within the chaplet and accumulator and which has a piston seal received about the piston stem that forms a seal with inner walls of the accumulator.

A compression spring, which is in most cases metal, is disposed within the accumulator and is captured between the bottom wall of the accumulator and a bottom surface of the piston seal. A second ball valve is positioned within the piston stem.

In accordance with the invention, to make the chaplet removable, the outer wall has a frangible wall portion which includes an outwardly extending pull tab at a terminal edge thereof. In some exemplary embodiments, the frangible wall portion comprises a tear-away strip secured to the body portion by a plurality of spaced frangible elements extending around a periphery of the chaplet. An upward and outward pull on the pull tab will sever the frangible elements around the periphery of the body portion, releasing the outer wall from the rim wall and allowing the chaplet, dispensing head and compression spring to be easily removed from the accumulator. In other exemplary embodiments, the frangible wall portion is secured to a main wall portion by spaced frangible seams which are broken upon an upward pull of the pull tab.

BRIEF DESCRIPTION OF THE DRAWINGS

While the specification concludes with claims particularly pointing out and distinctly claiming particular embodiments of the instant invention, various embodiments of the invention can be more readily understood and appreciated from the following descriptions of various embodiments of the invention when read in conjunction with the accompanying drawings in which:

DETAILED DESCRIPTION OF THE INVENTION

Figure 1:
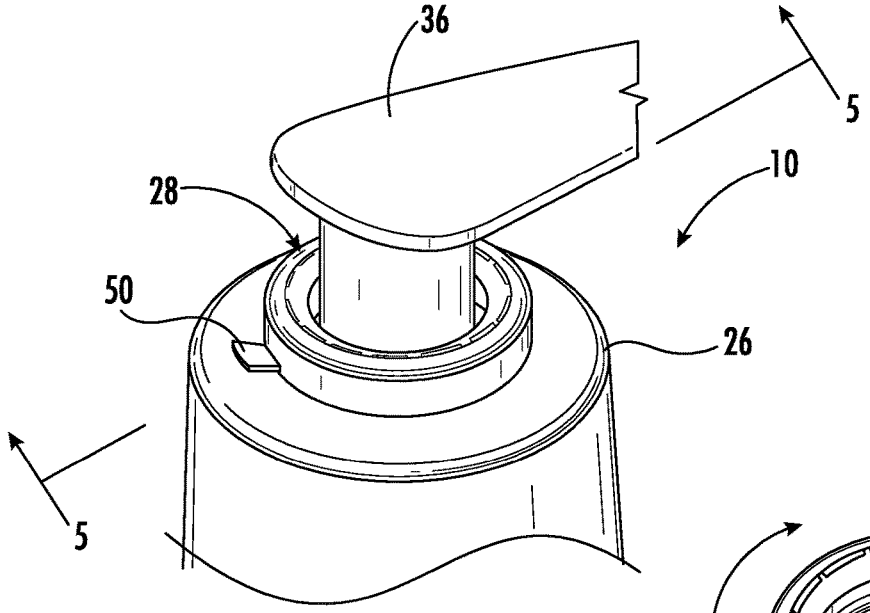
FIG. 1 is a perspective view of an exemplary dispensing pump system in accordance with the present invention.

Referring now to the drawings, an exemplary embodiment of a dispensing pump system and removable chaplet in accordance with the teachings of the present invention is illustrated in FIGS. 1-12.

Embodiments of the present dispensing pump system 10 may be advantageously used for various liquids, lotions, etc. contained within a bottle or other container (not illustrated). In some exemplary embodiments, many of the components of the pump system (with the exception of the metal spring) are molded from the same plastic material making the dispensing pump system easily recyclable in a single plastic material classification.

The dispensing pump system 10 includes an accumulator 12 having a clip tube port 14 within a bottom wall 16 and a ball valve 18 within the clip tube port 14. A clip tube 20 extends from the dip tube port 14. The open upper end of the accumulator 12 has an outward flange 22 and an upstanding rim wall 24. The pump system 10 further includes an annular closure ring 26 engaging the accumulator flange 22 and securing the accumulator 12 to a neck of a container. Some embodiments of the closure ring 26 may be threaded while others may be snap received onto the neck of the container.

Figure 12:
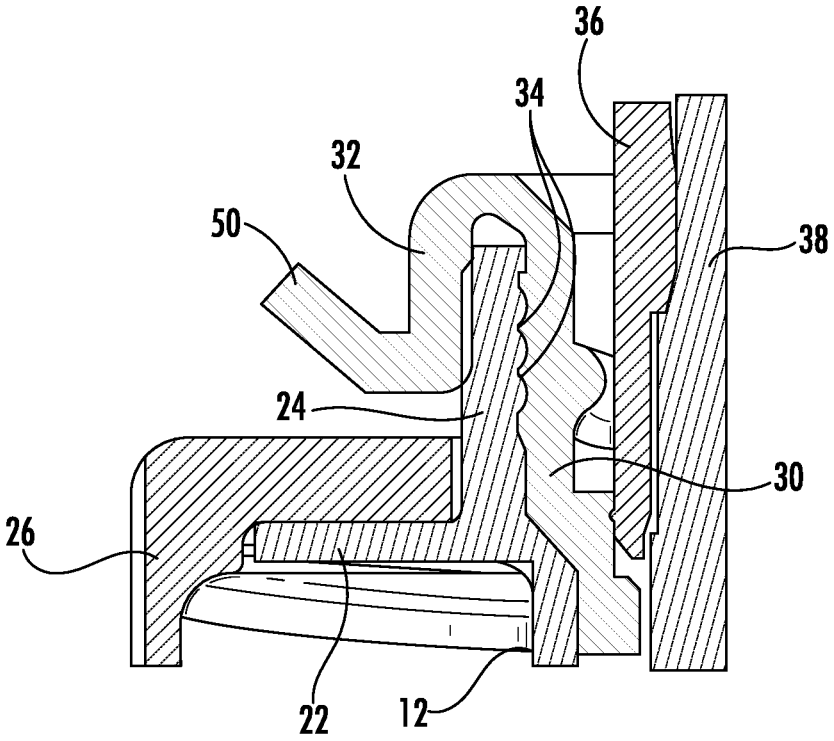
FIG. 12 is an enlarged perspective view of the mating snap formations.
Figure 13:
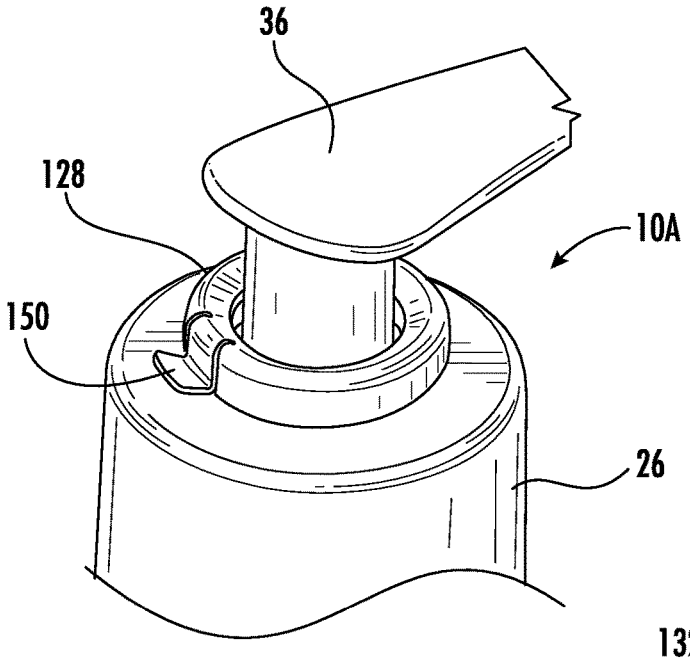
FIG. 13 is a perspective view of another exemplary dispensing pump system.
Figure 14:
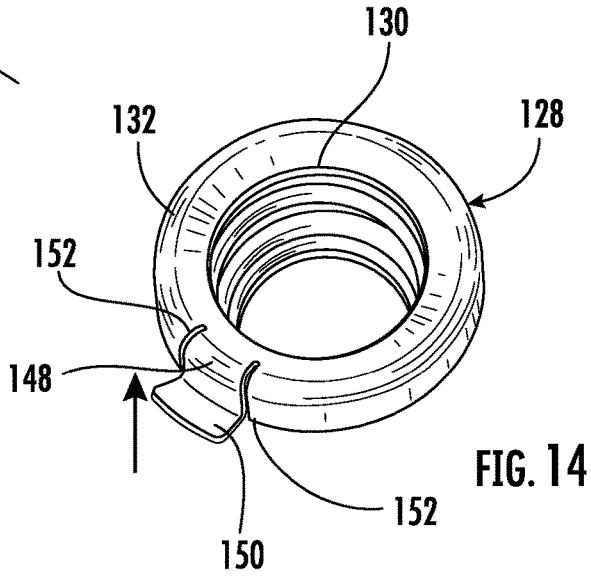
FIG. 14 is a perspective view of another exemplary embodiment of the removable chaplet.
Figure 15:
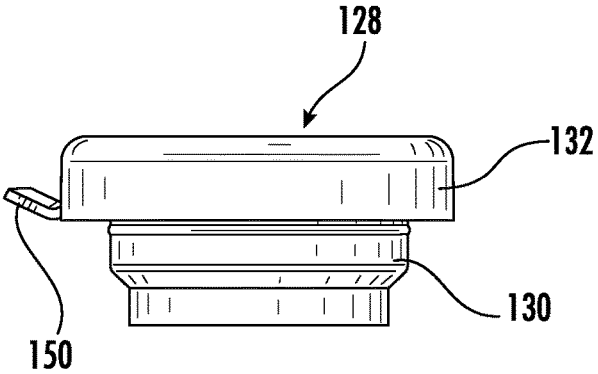
FIG. 15 is a side view thereof.
Figure 16:
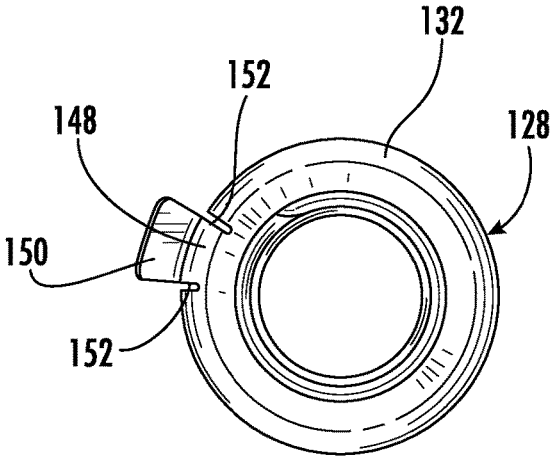
FIG. 16 is a top view thereof.

A removable, annular chaplet 28 is coaxially, snap received about the rim wall 24 of the accumulator 12. The chaplet 28 has a body portion 30 which is received within inner side of the rim wall 24, and an outer wall 32 received on an outer side of the rim wall 24. Referring to FIG. 12, the inner surface of the rim wall 12 and the outer surface of the chaplet 30 include mating snap formations 34 which cooperate to maintain the chaplet 28 in assembled relation with the rim wall 24.

Referring back to FIGS. 5-11, a dispensing head 36 includes a tubular piston stem 38 which is coaxially guided within the chaplet 28 and the accumulator 12. The piston stem 38 has an integral piston seal 40 formed about the bottom end thereof that forms a seal with inner walls of the accumulator 12. A second ball valve 42 is positioned within the tubular piston stem 38.

A compression spring 44, which in most embodiments is metal, is disposed within the accumulator 12 and is captured between the bottom wall of the accumulator 12 and a bottom surface of the piston seal 40. Some embodiments may include a dispenser seal 46 disposed on the bottom wall surrounding the ball valve 18.

Figure 10:
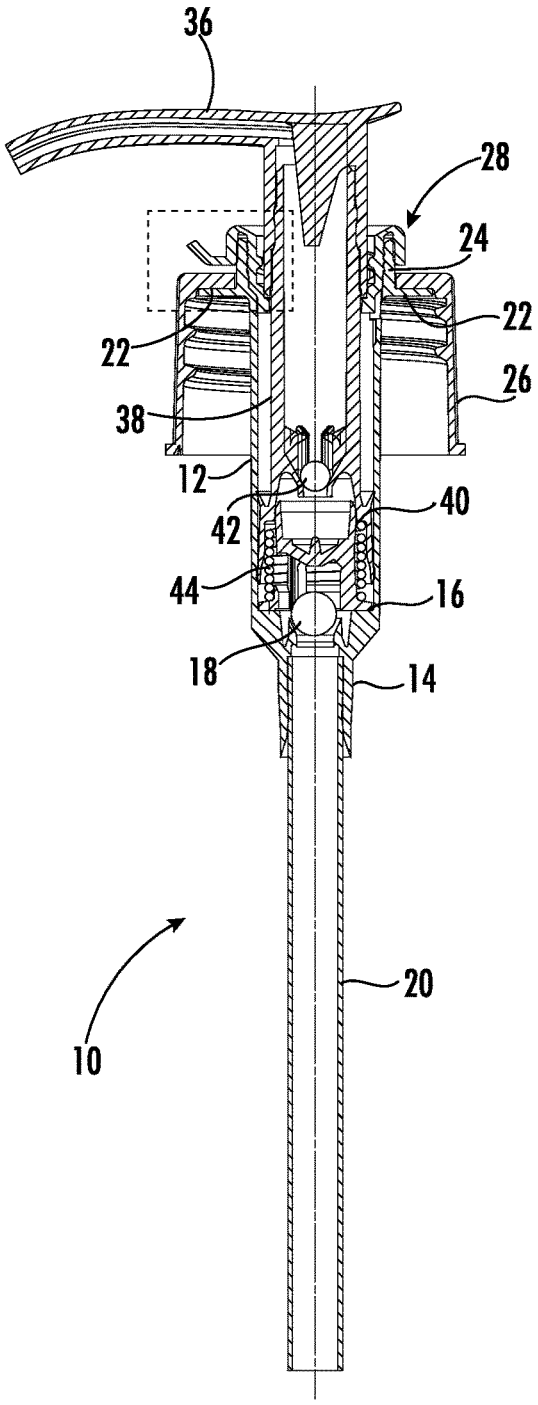
FIG. 10 is a cross-sectional assembled view as taken along line 10-10 of FIG. 7
Figure 11:
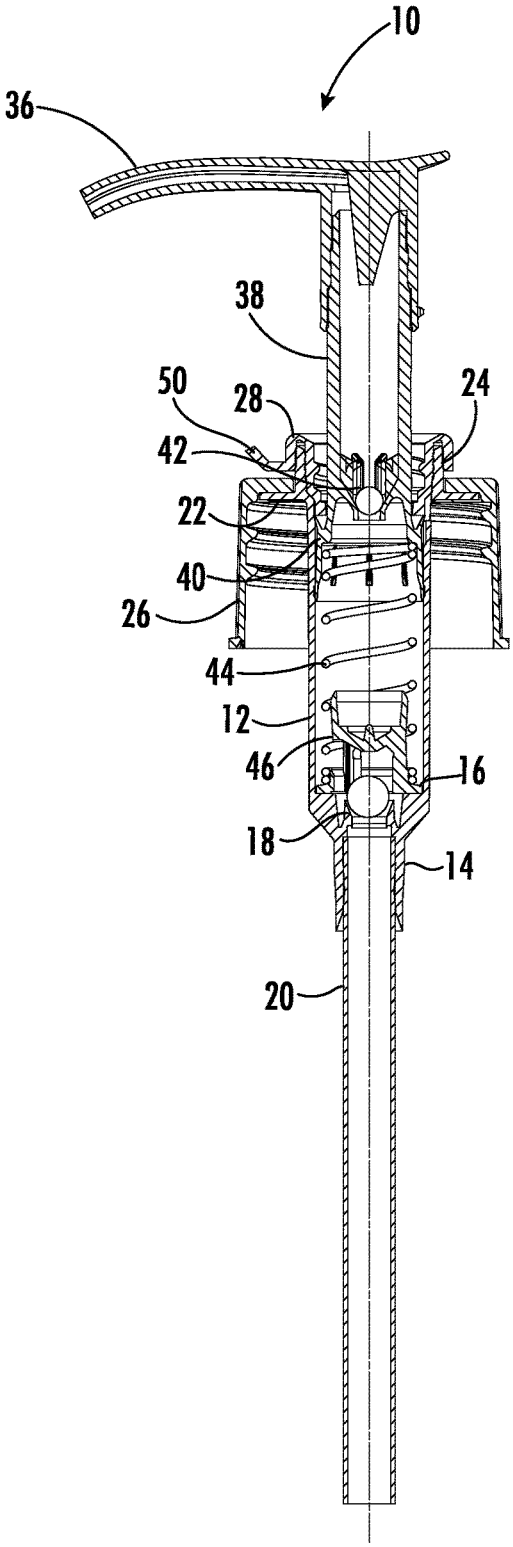
FIG. 11 is another cross-sectional view thereof with the dispensing head in an extended position.

In operation of the pump system 10, a forcible downward compression of the dispensing head 36 causes a corresponding downward axial movement of the piston stem 38 and compression of the spring 44 (See FIGS. 10 and 11). Upon the subsequent release of the dispensing head 36, the spring 44 expands back to its normal at rest shape causing a forcible upward movement of the piston stem 38 and dispensing head back to their normal at rest positions. The ball valves 18 and 42 operate to draw material up from the clip tube 20 and dispense the material through the dispensing head 36.

Figure 2:
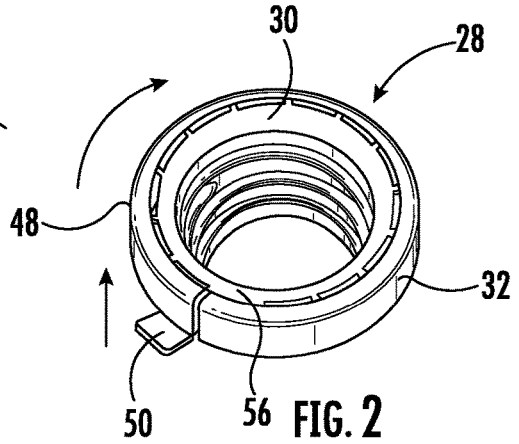
FIG. 2 is a perspective view of an exemplary removable chaplet.
Figure 3:
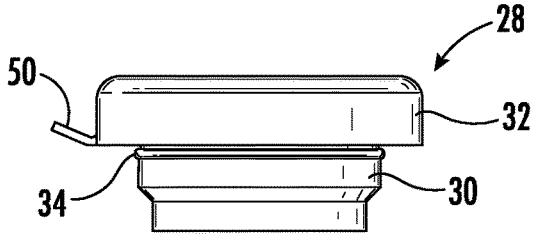
FIG. 3 is a side view thereof.
Figure 4:
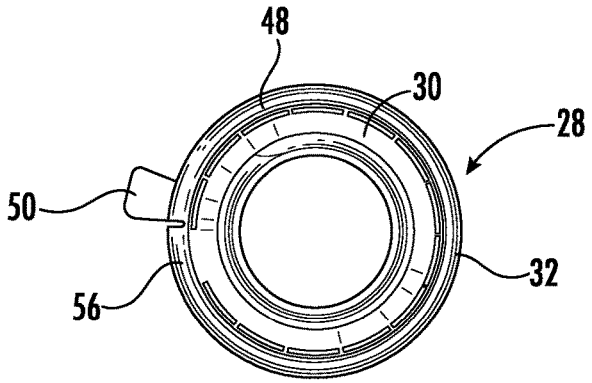
FIG. 4 is a top view thereof.
Figure 5:
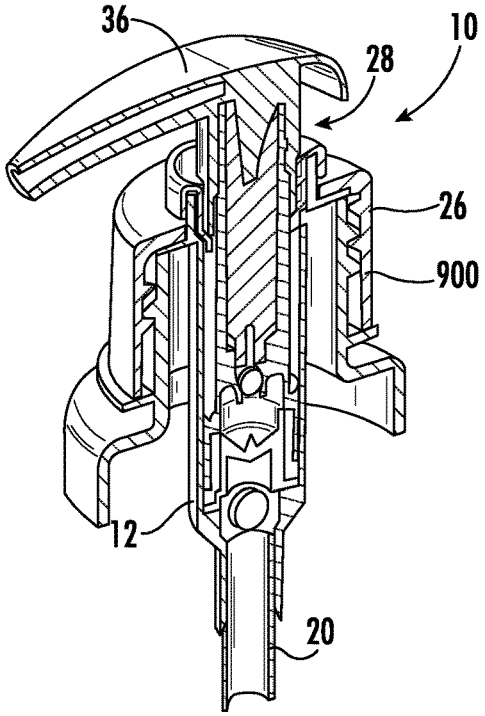
FIG. 5 is a cross-sectional view of the pump system as taken along line 5-5 of FIG. 1.
Figure 6:
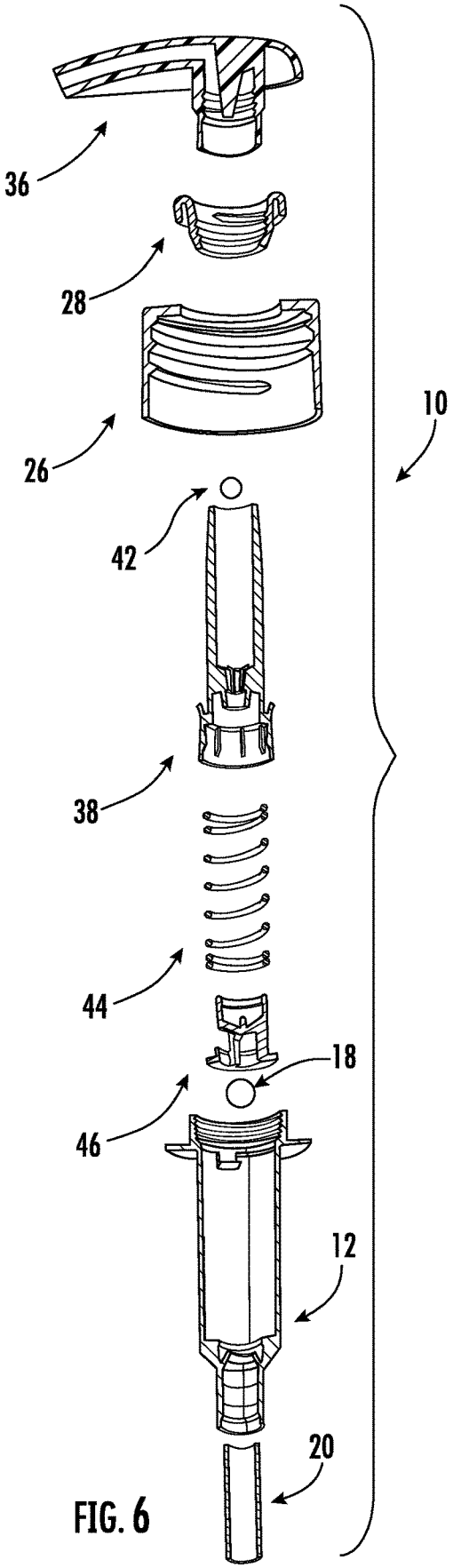
FIG. 6 is an exploded cross-section view thereof.
Figure 7:
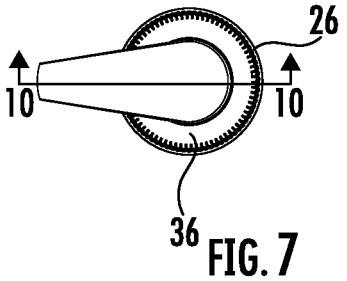
FIG. 7 is a top view thereof.
Figure 8:
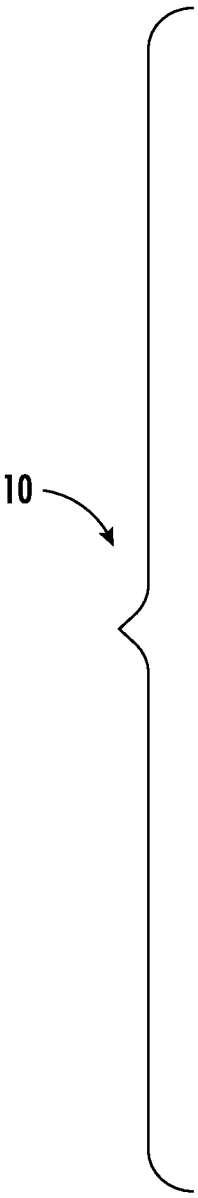
FIG. 8 is an exploded cross-sectional view thereof.
Figure 9:
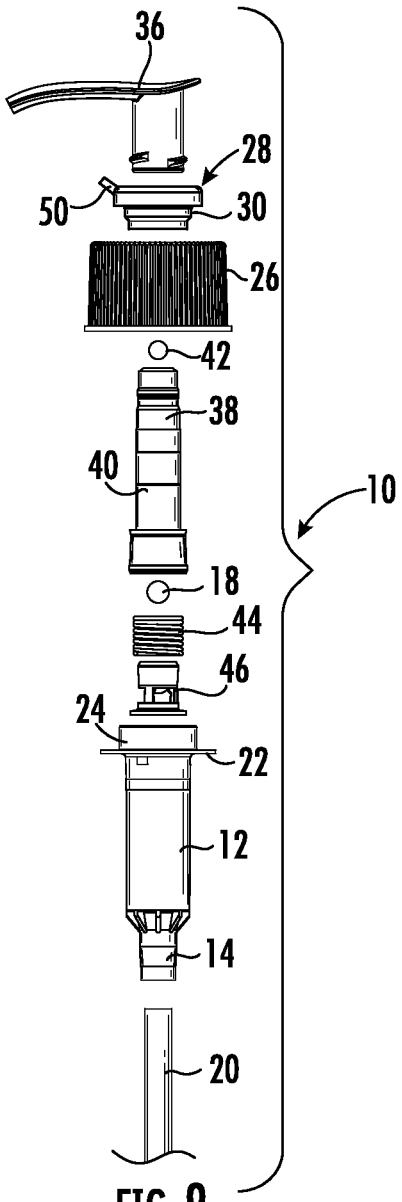
FIG. 9 is an exploded side view thereof.

In accordance with the teachings of the invention herein, to make the chaplet 28 removable, the outer wall 32 has a frangible wall portion 48 which includes an outwardly extending pull tab 50 at a terminal edge thereof. In some exemplary embodiments, the frangible wall portion 48 comprises a tear-away strip (see FIGS. 1-12) secured to the body portion 30 by a plurality of spaced frangible elements 52 extending around a periphery of the chaplet 28. An upward and outward pull on the pull tab 50 (See arrows in FIG. 2) will sever the frangible elements 52 around the periphery of the body portion, releasing the outer wall 32 from the rim wall 24 and allowing the chaplet 28, dispensing head 36 and compression spring 44 to be easily removed from the accumulator 12. In FIG. 2 it can be seen that there is a reinforced area 56 at terminal end of the tear strip which translates the outward pulling force to the main body 30.

Referring again briefly to FIG. 12, the dimension between the outer surface of the chaplet body 30 and the inner surface of the chaplet outer wall 32 is smaller than the thickness of the accumulator rim wall 24. In this manner, when the chaplet 28 is snap received onto the rim wall 24, the outer wall 32 urges the rim wall 24 and chaplet body 30 into engagement and more fully secures the snap formations 34. Removal of the frangible outer wall portion 48 releases pressure and allows the chaplet body 30 to be more easily pulled away from the accumulator rim wall 24.

Turning to FIGS. 13-16, other exemplary embodiments of the removable chaplet 128 may comprise a body 130, an outer wall 132 and a frangible wall portion 148 which is secured to the main outer wall portion 132 by spaced, vertically extending, frangible seams 152 which are broken upon an upward pull of the pull tab 150.

It can therefore be seen that the exemplary embodiments provide unique and novel dispensing pump assemblies in which the discrete components may be easily disassembled to facilitate plastic recycling.

While there is shown and described herein certain specific structures embodying various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims

What is claimed is:

1. A dispensing pump system comprising:

an accumulator having a rim wall;

a closure ring securing said accumulator to a neck of a container;

a chaplet coaxially received about said rim wall of said accumulator, said chaplet having a body portion received within said rim wall, and an outer wall received outside of said rim wall, said outer wall having a frangible wall portion including a pull tab;

a dispensing head including a piston stem coaxially guided within the chaplet and accumulator;

a compression spring captured between said accumulator and said piston stem.

2. The dispensing pump system of claim 1 wherein said rim wall and said chaplet include mating snap beads which cooperate to maintain said chaplet in assembled relation with said rim wall.

3. The dispensing pump system of claim 2 wherein said frangible wall portion is secured to a main wall portion by spaced frangible seams.

4. The dispensing pump system of claim 2, wherein said frangible wall portion comprises a tear-away strip secured to said body portion by a plurality of spaced frangible elements extending around a periphery of said chaplet.

5. The dispensing pump system of claim 1, wherein said frangible wall portion comprises a tear-away strip secured to said body portion by a plurality of spaced frangible elements extending around a periphery of said chaplet.

6. A dispensing pump system comprising:

an accumulator having a dip tube port within a bottom wall and further having a rim wall at an upper end thereof;

a ball valve within said dip tube port;

a closure ring securing said accumulator to a neck of a container;

a chaplet coaxially received about said rim wall of said accumulator, said chaplet having a body portion received on an inner side of said rim wall, and an outer wall received on an outer side of said rim wall, said outer wall having a frangible wall portion including a pull tab at a terminal edge thereof;

a dispensing head including a piston stem which is coaxially guided within the chaplet and accumulator and which has a piston seal received about the piston stem that forms a seal with inner walls of the accumulator;

a compression spring disposed within said accumulator and captured between said accumulator bottom wall and a bottom surface of said piston seal; and a ball valve within said piston stem.

7. The dispensing pump of claim 6 wherein said rim wall and said chaplet include mating snap beads which cooperate to maintain said chaplet in assembled relation with said rim wall.

8. The dispensing pump of claim 7 wherein said frangible wall portion is secured to a main wall portion by spaced frangible seams.

9. The dispensing pump of claim 7 wherein said frangible wall portion comprises a tear-away strip secured to said body portion by a plurality of spaced frangible elements extending around a periphery of said chaplet.

10. The dispensing pump of claim 6 wherein said frangible wall portion is secured to a main wall portion by spaced frangible seams.

11. The dispensing pump of claim 6 wherein said frangible wall portion comprises a tear-away strip secured to said body portion by a plurality of spaced frangible elements extending around a periphery of said chaplet.

* * * * *